US006157800A

United States Patent [19]

Ishiyama et al.

[11] Patent Number: 6,157,800

[45] Date of Patent: Dec. 5, 2000

[54] CHARGING DEVICE USING A MAGNETIC BRUSH CONTACTABLE TO A MEMBER TO BE CHARGED AND IMAGE FORMING APPARATUS USING SAME

[75] Inventors: Harumi Ishiyama; Hideyuki Yano, both of Yokohama; Tadashi Furuya, Kawasaki, all of Japan

[73] Assignee: Canon Kabushiki Kaisha, Tokyo, Japan

[21] Appl. No.: 08/512,339

[22] Filed: Aug. 8, 1995

[30] Foreign Application Priority Data

Aug. 8, 1994 [JP] Japan ..... 6-208062
Jul. 31, 1995 [JP] Japan ..... 7-194984

[51] Int. Cl.[7] ..... G03G 15/02

[52] U.S. Cl. ..... 399/175

[58] Field of Search ..... 355/219; 361/220, 361/221, 225; 399/174–176

[56] References Cited

U.S. PATENT DOCUMENTS 5,202,729 4/1993 Miyamoto et al. ..... 355/251
5,235,386 8/1993 Yano et al. ..... 355/219
5,321,482 6/1994 Yano et al. ..... 355/299
5,351,109 9/1994 Haneda ..... 355/219
5,367,365 11/1994 Haneda et al. ..... 355/219
5,381,215 1/1995 Haneda et al. ..... 355/219

FOREIGN PATENT DOCUMENTS

0598483A1 5/1994 European Pat. Off. .
0696765A2 2/1996 European Pat. Off. .

OTHER PUBLICATIONS

D2=E.U. Condon and H. Odishaw, Handbook of Physics, 1958, New York, McGraw–Hill Book Company, pp. 4–8 and 4–10.

Journal of Applied Physics, vol. 62, No. 7, Oct. 1, 1987, pp. 2665–2668, "New photoreceptor charging method by rubbing with magnetic conductive particles", Tetsutani, et al.

*Primary Examiner*—William J. Royer
*Attorney, Agent, or Firm*—Fitzpatrick, Cella, Harper & Scinto

[57] ABSTRACT

A charging device for charging a member to be charged includes a charging member to which a voltage is applicable to charge the member to be charged, the charging member having a magnetic brush of magnetic particles contactable to the member to be charged, and a supporting member for supporting the magnetic particles; wherein the the magnetic particles have a resistance value of $1\times10^4$–$1\times10^7$ (Ohm) when 1–1000(V) is applied thereto.

15 Claims, 5 Drawing Sheets

CHARGING DEVICE USING A MAGNETIC BRUSH CONTACTABLE TO A MEMBER TO BE CHARGED AND IMAGE FORMING APPARATUS USING SAME

FIELD OF THE INVENTION AND RELATED ART

The present invention relates to a charging device having a charging member contactable to a member to be charged such as a photosensitive member or a dielectric member. The charging device is preferably usable with an image forming apparatus such as a copying machine or printer, and with a process cartridge detachable from the apparatus.

As a charging device for an electrophotographic apparatus, a corona charging type has been mainly used which comprises a wire and shield. Recently, however, a contact charging type has been increasingly used from the standpoint of environment problems, since the ozone product due to it is much less. As one of the charging members used for the contact charging type, a magnetic brush is known.

With the magnetic brush charging type, the contact chance between a member to be charged and the charging member can be increased, and therefore, it is suitable to an injection charging type by which the current flows through the contact portion between the photosensitive member as the member to be charged and the charging member to inject the charge into the photosensitive member.

If, however, use is made of magnetite as the magnetic particle on the magnetic brush, the voltage dependence property of the resistance value gives rise to the following problems.

Even if the resistance value of the magnetic brush of the magnetic particles of the magnetite is not less than $1\times10^4$ Ohm with which a pin hole leakage does not occur when 100V DC voltage is applied, the resistance of the magnetic brush is lower with the application voltage at the time of charging (for example −700V) to such an extent that the leakage occurs at the pin hole of the photosensitive member, with the result of lateral line in the form of the charging nip extending in the longitudinal direction, on the image as a lateral line.

On the other hand, even if the resistance of the magnetic particle is not more than $1\times10^7$ Ohm with which the charging defect does not occur upon 100V application, the resistance value of the magnetic brush changes during the actual charging operation with the result of the charging defect.

SUMMARY OF THE INVENTION

Accordingly, it is a principal object of the present invention to provide a charging device and an image forming apparatus wherein the charge uniformity is improved, and the leakage through the pin hole of the surface of the member to be charged is prevented.

It is another object of the present invention to provide a charging device and an image forming apparatus wherein charging power is improved.

These and other objects, features and advantages of the present invention will become more apparent upon a consideration of the following invention taken in conjunction with the accompanying drawings.

DESCRIPTION OF THE PREFERRED EMBODIMENT

Referring to the accompanying drawings, the embodiments of the present invention will be described.

Embodiment 1

Figure 1:
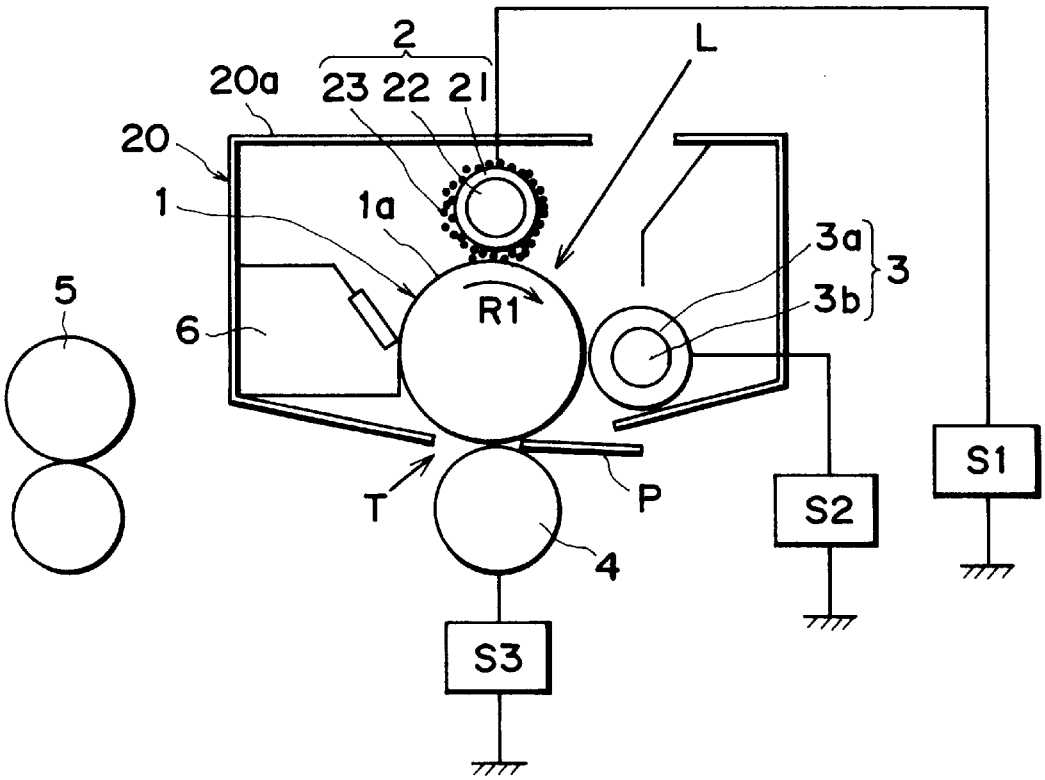
FIG. 1 is a schematic view of an image forming apparatus according to embodiment 1.

FIG. 1 shows a laser beam printer of electrophotographic type as an an example of image forming apparatus having a charging device according to an embodiment of the present invention. The structure and operation will be described briefly.

The image forming apparatus comprises a drum type electrophotographic photosensitive member (photosensitive member) 1 as the image bearing member. The photosensitive member 1 has a diameter of 30 mm and is an OPC photosensitive member, which is rotated in the arrow R1 direction at a process speed (peripheral speed) of 100 mm/sec.

To the photosensitive member 1, an electroconductive magnetic brush as a contact charging member is contacted. The electroconductive magnetic brush 2 has a fixed magnet roller 22 within a rotatable non-magnetic charging sleeve 21, and the magnetic particles 23 are carried on the non-magnetic charging sleeve 21 by the magnetic force of the magnet 22. To the charging member 2, a DC charging bias of −700V is applied from a charging bias application voltage source S1, so that the photosensitive member 1 surface is substantially uniformly charged to approximately −700V.

The thus charged surface 1*a* of the photosensitive member 1 is exposed to and scanned by a laser beam 6 having an intensity modulated in accordance with time series electric digital pixel signal corresponding to the intended image information, so that an electrostatic latent image thereof is formed. The laser beam is projected from an unshown laser beam scanner including a laser diode, polygonal mirror or the like. The electrostatic latent image is developed into a toner image by using magnetic one component insulative toner. The developing device 3 has a non-magnetic developing sleeve 3 a having a diameter of 16 mm containing therein a magnet 3*b*. Negative toner is applied on the developing sleeve 3*a*. It is rotated at the same peripheral speed as the photosensitive member 1 while a fixed gap of 300 microns is maintained therebetween. To the developing sleeve 3*a*, a developing bias voltage is applied from a developing bias voltage source S2. The voltage is a DC voltage of −500V biased with a rectangular AC voltage having a frequency of 1800 Hz and a peak-to-peak voltage 1600V to effect a jumping development between the developing sleeve 3*a* and the photosensitive member 1.

On the other hand, a transfer material P as a recording material is fed from an unshown sheet feeding portion into a press-contact nip portion (transfer portion) T at a predetermined timing. The press-contact nip portion (transfer portion) T is formed between the photosensitive member 1 and a transfer roller 4 having an intermediate resistance of $10^6$–$10^9$ Ohm (contact transfer means) press-contacted to the photosensitive member 1 at a predetermined pressure. To the transfer roller 4, a predetermined transfer bias voltage is applied from the transfer bias application voltage source S3.

The transfer roller 4 of this embodiment has a roller resistance value of $5\times10^8$ Ohm, and a DC voltage of +2000V is applied thereto.

A transfer material P introduced into the transfer portion T, is advanced by the nip, and the toner image is transferred onto the transfer material P by the pressure and the electrostatic force.

The transfer material P now having the transferred toner image thereon is separated from the surface of the drum, and is introduced to a heat fixing type fixing device 5, where the toner image is fixed on the transfer material P. The transfer material P is finally discharged to the outside as a print or copy.

On the other hand, the photosensitive member 1, after the toner image is transferred therefrom, is cleaned by a cleaning device 6 so that residual toner or deposited contamination are removed therefrom to be prepared for the next image forming operation.

The image forming apparatus of this embodiment is a cartridge type. That is, a process cartridge 20 integrally comprising four process means, namely, the photosensitive member 1, the contact charging member 2, the developing device 3 and the cleaning device 6, is detachably mountable to a main assembly of the image forming apparatus. However, the present invention is applicable to an image forming apparatus of non-cartridge-type.

Figure 2A:
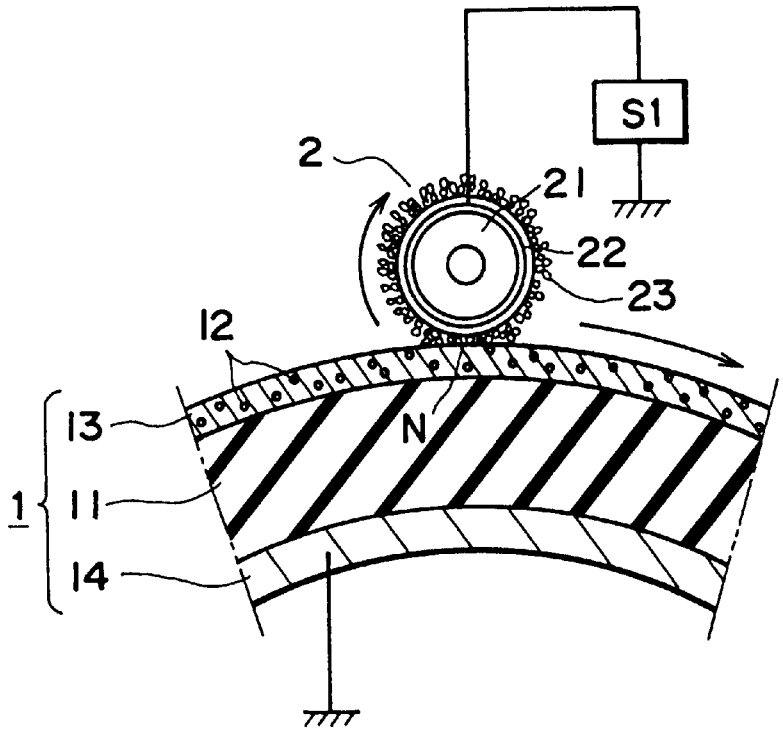
FIGS. 2A and 2B show an enlarged longitudinal section of a photosensitive member and a principle of charge injection according to embodiment 1.
Figure 2B:
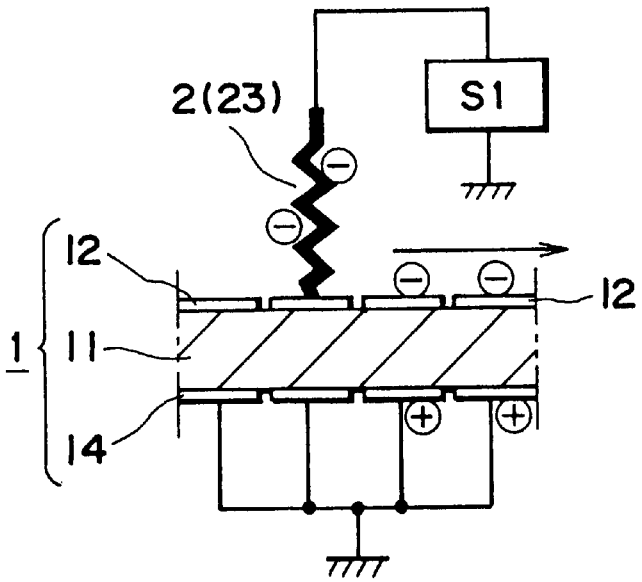

Referring to FIG. 2, the description will be made as to the photosensitive member 1.

It is of negative charging property, and comprises an electroconductive base 14 of aluminum having a diameter of 30 mm, first–fifth function layers from the bottom.

The first layer on the base is an electroconductive primer layer functioning to smooth defects of the aluminum drum base and to prevent moire attributable to the reflection of the laser exposure beam.

The second layer is a positive charge injection layer, which functions to prevent the positive charge injected from the aluminum drum base from neutralizing the negative charge applied on the photosensitive member surface. The second layer is an intermediate resistance layer having a thickness of approximately 1 micron. The resistance thereof is adjusted by AMILAN (tradename of polyamide resin material, available from Toray Kabushiki Kaisha, Japan) resin material and methoxymethyl nylon.

The third layer is a charge generating layer of disazo pigment dispersed in a resin material and having a thickness of approximately 0.3 microns. It produces a pair of positive and negative charge when it is subjected to laser exposure.

The fourth layer is a charge transfer layer of hydrazone dispersed in polycarbonate resin material, and is a P-type semiconductor. Therefore, the negative charge on the photosensitive member surface cannot move through the layer, and can transfer only the positive charge produced in the charge generating layer to the photosensitive member surface.

The fifth layer is a charge injection layer as a surface charge injection layer, and is an applied layer of $SnO_2$ ultra-fine particle dispersed in the light curing acrylic resin material. More particularly, the $SnO_2$ particles having a particle size of approximately 0.03 microns doped with antimony to lower the resistance thereof are dispersed in the resin material in the amount of 70 wt %. The painting liquid thus provided is applied as the charge injection layer into the thickness of approximately 2 microns by dipping. By doing so, the volume resistivity of the photosensitive member surface is lowered to volume resistivity $1\times10^{12}$ Ohm·cm from $1\times10^{15}$ Ohm·cm in the case of of the charge transfer layer alone. It is preferable that the volume resistivity of the charge injection layer is $1\times10^9$–$1\times10^{15}$ Ohm·cm. The volume resistivity is measured using a sheet-like sample with the voltage of 100V, and it is measured using HIGH RESISTANCE METER 4329A available from YHP to which RESISTIVITY CELL 16008A is connected.

Referring to FIG. 2, the charging device will be described.

Designated by 2 in the Figure is an electroconductive magnetic brush as the contact charging member contacted to the photosensitive member 1, and it comprises a non-magnetic electroconductive charging sleeve 21 having an outer diameter of 16 mm, a magnet roller 22 therein and magnetic particles 23 on the charging sleeve 21. The magnet roller 22 is fixed, and the charging sleeve 21 is rotatable. The magnetic flux density provided by the magnet is $800\times10^{-4}$T (tesla) at the charging sleeve 21 surface. The magnetic particles 23 are applied on the charging sleeve 21 into a thickness of 1 mm and a width of 220 mm to form a charging nip with the photosensitive member 1 in a width of approximately 5 mm. To the sleeve 21, a DC charging bias of −700V is applied from charging bias application voltage source S1 so that the surface 1*a* of the photosensitive member 1 is substantially uniformly charged to −700V.

Figure 5:
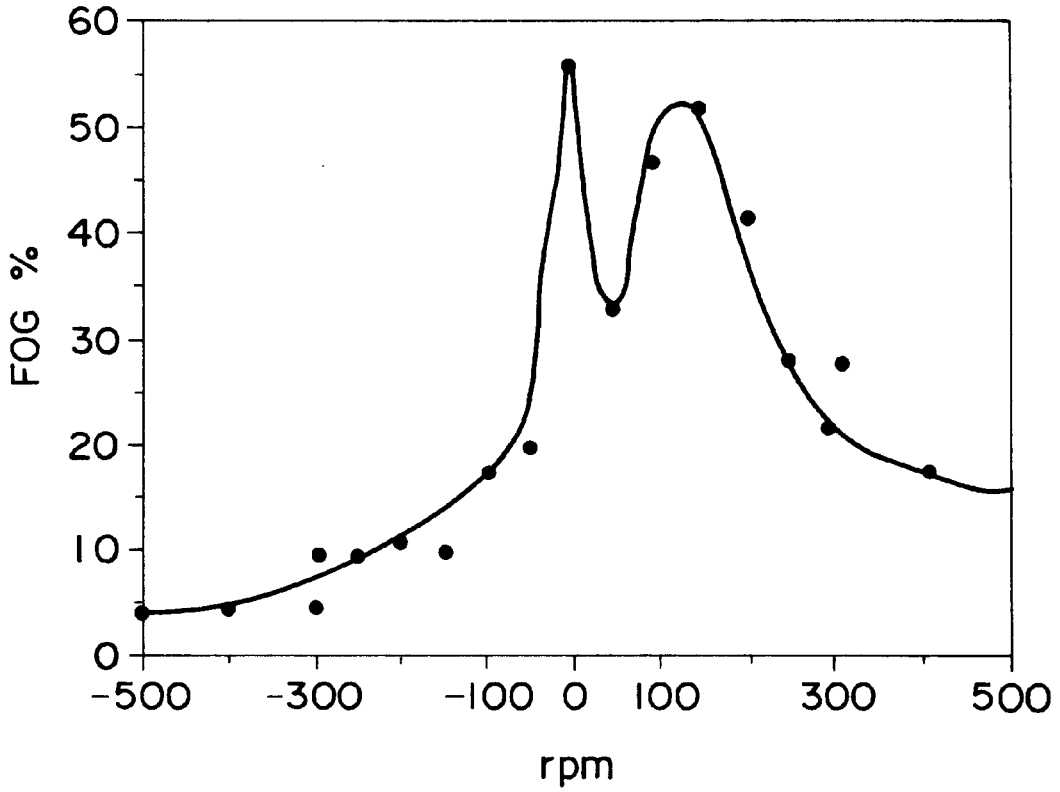
FIG. 5 is a graph of a rotational frequency of magnetic brush vs. charging fog.

FIG. 5 shows a relation between the rotational frequency of the charging sleeve 21 and image fog due to charging which is indicative of charging power in a reverse development. The fog increases with increase of charging defect when the charge is not sufficiently injected into the photosensitive member, and decreases when the charge is uniformly injected. The positive value of the rotational frequency on the abscissa means the rotation codirectional with the photosensitive member 1, 1 (peripheral movement at the contact portion), the negative value means counterdirectional. As will be understood, the amount of the fog can be decreased by the rotational direction. In the case of the counterdirection, a good charging property can be provided since the magnetic particles 23 having departed the charging nip is discharged from the charge-up state during one rotation around the charging sleeve 21, and then the discharged magnetic particles 23 are contacted to the photosensitive member 1. However, in the case of codirection, after the magnetic particles 23 are contacted to the surface of the photosensitive member 1, they sequentially overtake the surface, and therefore, the very charged-up magnetic particles 23 are contacted to the photosensitive member 1 adjacent the exit of the charging nip. For this reason, the charging property is not so good as in the counterdirection.

In order to provide the charging property enough to prevent the fog, not less than 294 rpm(peripheral speed 200 mm /sec) of the rotational frequency is preferable in the codirectional case, but in the case of opposite direction, it will suffice if the charging sleeve 21 is rotated at a low speed. At the peculiar point of rotational frequency of 0 rpm in the graph, the brush is at rest, and the charging property is deteriorated by charge-up.

Thus, when the rotational speed of the sleeve 21 is the same, the charging property of less fog can be provided in the counterdirectional case than the codirectional case relative to the movement of the surface of the photosensitive member.

The description will be made as to the charging principle when the contact charging member 2 charges the photosensitive member 1.

The injection charging type is such that the charge injection is effected into the photosensitive member surface having an intermediate surface resistance by the contact charging member 2 having an intermediate resistance. The injection charging type of this embodiment is not such that the charge is injected into the trap potential of the material of the photosensitive member surface, but the electroconductive particles of the charge injection layer are charged.

More particularly, as shown in FIG. 2, a fine capacitor constituted by the charge transfer layer 11 as a dielectric member and the aluminum base 14 and the electroconductive particles 12 in the charge injection layer 13 as electrode plates, is charged by the contact charging member 2. The electroconductive particles 12 are substantially independent from each other, electrically, so that a kind of fine float electrode is formed. Macroscopically, the photosensitive member surface seems to be charged or discharged uniformly, but actually, a great number of fine charged $SnO_2$ particles covers the photosensitive member surface. Therefore, when the image exposure is effected, the electrostatic latent image can be retained since the $SnO_2$ particles are electrically independent.

As for examples the magnetic particle constituting the magnetic brush 23, the following is considered:

A kneaded mixture of resin material and the magnetic powder members such as magnetite is formed into particles, or the one further mixed with electroconductive carbon or the like for the purpose of resistance value control.

Sintered magnetite or ferrite, or the one deoxidized or oxidized provided for the purpose of control of resistance value.

The above magnetic particles coated with resistance-adjusted coating material (for example, carbon dispersed in the phenolic resin), or plated with metal to adjust the resistance value to a proper level.

Figure 3:
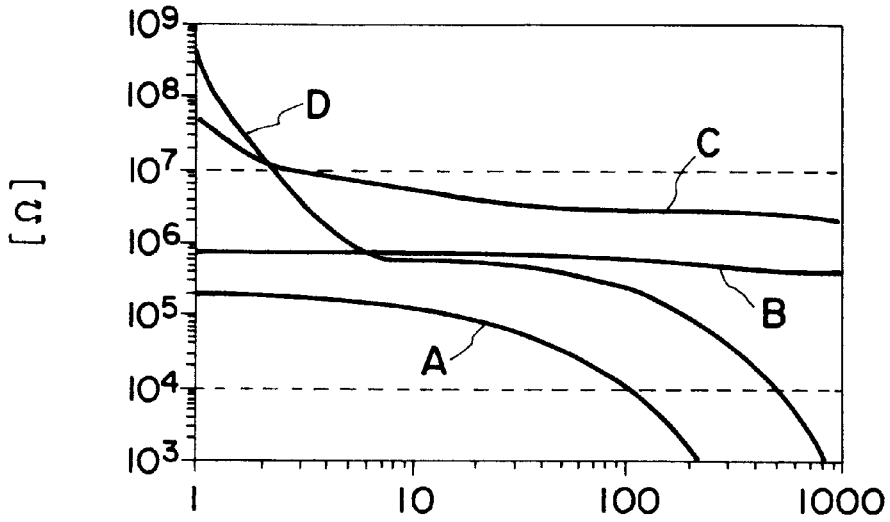
FIG. 3 is a graph of an application voltage vs. a resistance value of magnetic particles.

As for the resistance value of the magnetic particle 23, if it is too high, the charge is not uniformly injected into the photosensitive member 1, with the result of fog image attributable to the fine charging defect. If it is too low, on the contrary, when the photosensitive member surface has a pin hole, the current is concentrated to the pin hole with the result of the voltage drop so that the photosensitive member surface cannot be charged. If this occurs, charging defect in the form of charging nip-like appear on the image. Usually, the resistance value of magnetic particles 23 is measured with one or two application voltage (1–100V), but the resistance value of the magnetic particles 23 changes depending on the applied voltage as shown in the graph of FIG. 3.

The pin hole leakage is determined by the resistance value upon height to the charging member. More particularly, when the pin hole of the photosensitive member comes to the nip portion, the difference between the ground of the photosensitive member base layer and the voltage applied to the magnetic particles, is applied across the magnetic particles at the pin hole portion. Therefore, it is preferable that an excessive current does not flow at this time. In order to accomplish this, the resistance value of the magnetic particles at the maximum application voltage Vmax(V) applied to the charging member is desirably not less than $1\times10^4$ Ohm. If the resistance value of the magnetic particles is smaller than $1\times10^4$ Ohm, leakage occurs by the Vmax(V).

Figure 7:
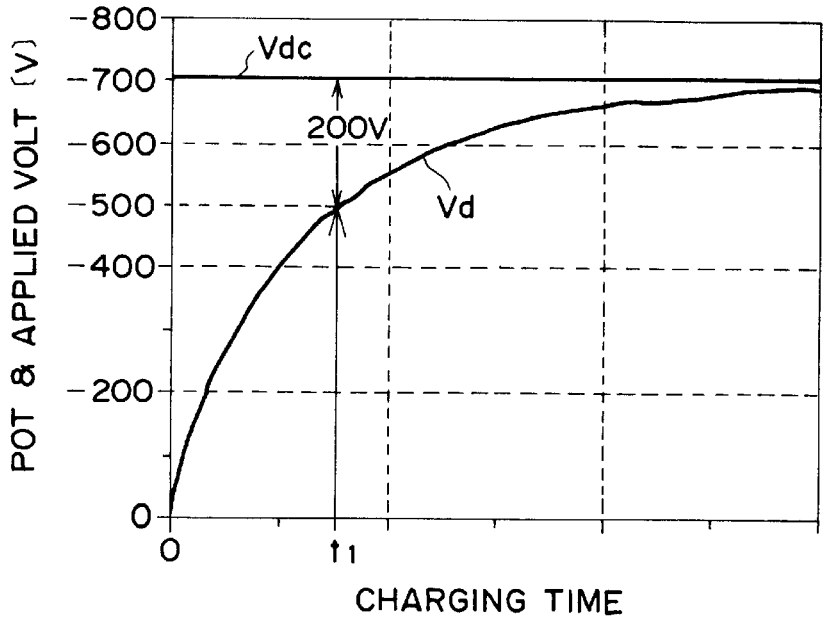
FIG. 7 is a graph of a charging time vs. photosensitive member potential.

On the other hand, the charging defect is determined by the resistance value upon low voltage application. In the injection charging type, as shown in FIG. 7, with elapse of contact time from the contact start between the photosensitive member and the charging member, the photosensitive member potential (Vd) approaches to the application voltage (Vdc) to the charging member. More particularly, if the photosensitive member potential at the start is 0V, then Vc=0, and Vdc=−700V at the time of t=0, and therefore, the voltage (Vdc−Vd) actually applied to the magnetic particles is −700V. At this time, the charging property is determined by the resistance of the magnetic particle upon 700V application. At a later timing (t=t1), Vd=−500V, and Vdc=−700V, so that the actual voltage across the magnetic particles is −200V. At this time, the resistance of the magnetic particles upon−200V application, determines the charging property. Thus, the voltage across the magnetic particles decreases with the approaching to the photosensitive member potential (Vd) to the charging member application voltage (Vdc). The current resistance of the magnetic particles is decisive to the charging property. If the resistance of the magnetic particles upon application of 1V is higher than $1\times10^7$ Ohm, it is not possible to transfer the charge from the magnetic particles to the photosensitive member within a predetermined period. Therefore, the charging defect occurs. In view of this, the resistance of magnetic particles is preferably not more than $1\times10^7$ Ohm. The resistance value at the low voltage side is one of the important points in this injection charging type. In the conventional contact charging member, a discharge is produced in a small gap, thus charging the photosensitive member, and therefore, the potential difference between the photosensitive member potential and the charging member is required to be higher than a discharge threshold, and therefore, the resistance value at such a low voltage is not a problem.

More specific examples will be described.

Image formation operations were carried out using the image forming apparatus described above, as to magnetic particles A–D having different resistances. FIG. 3 gives the resistance values of magnetic particles A–D at voltages. The results are shown in Table 1. As regards charging property, "G" means that the photosensitive member potential is approximately −700V after the surface once passed through the charging nip.

TABLE 1

| Sample | Resistance (1V) Ohm | Resistance (700v) Ohm | Vd(Vd) (V) | Leakage |
|---|---|---|---|---|
| A | $2\times10^5$ | $1\times10^3$ or lower | −700 | NG |
| B | $8\times10^5$ | $3\times10^5$ | −700 | Good |
| C | $5\times10^7$ | $3\times10^6$ | −650 | Good |
| D | $5\times10^8$ | $3\times10^3$ | −630 | NG |

With sample A, the resistance was low upon 700V application, and therefore, the leakage occurred at the pin hole. With sample B, a good charging property was exhibited without leakage at the pin hole with the charged level of 700V. With sample C, the resistance upon 1V application was so high that the charging up to 700V was not possible. With sample D, the resistance upon 1V application was so high that the charging to 700V was not possible, and the resistance upon 700V application was so low that the leakage occurred at the pin hole.

In this embodiment, it is preferable that the potential of the photosensitive member surface is substantially equal to the application voltage to the charging member after passing through the nip.

The potential of the photosensitive member charged by the charging member is preferably not less than 94% of application voltage. When the application voltage is 700V, the target surface potential is preferably not less than 658V.

Sample A is magnetite; sample B is copper zinc ferrite; sample C is oxidized copper zinc ferrite; and sample D is oxidized magnetite of sample A. The ferrite ($MO—Fe_2O_3$) and magnetite ($FeO—Fe_2O_3$) have similarities in structure with each other. However, most of ferrite materials have high resistances, whereas in the case of magnetite, the transfer of electronic is quite free between $Fe^{2+}$ and $Fe^{3+}$, and therefore, the resistance property shown by A in FIG. 3 is exhibited. Also, in the case of ferrite, if the metal ion other than $Fe^{3+}$ is smaller than the ionization potential (30.651eV) of $Fe^{2+}$ (for example , Al=28.447 and Sc=24.76eV), the transfer of electronic with $Fe^{3+}$ is permitted, and therefore, it is predicted that the resistance property shown by A in FIG. 3 is exhibited. For this reason, if the third ionization potential of metal other than iron in ferrite is higher than the third ionization potential of iron, such a resistance property that the resistance value is $1\times10^4$–$1\times10^7$ Ohm at the application voltage 1–1000V as indicated by B in FIG. 3, is exhibited. This is effective for improvement of the charging property and drum pin hole leakage prevention.

Figure 4:
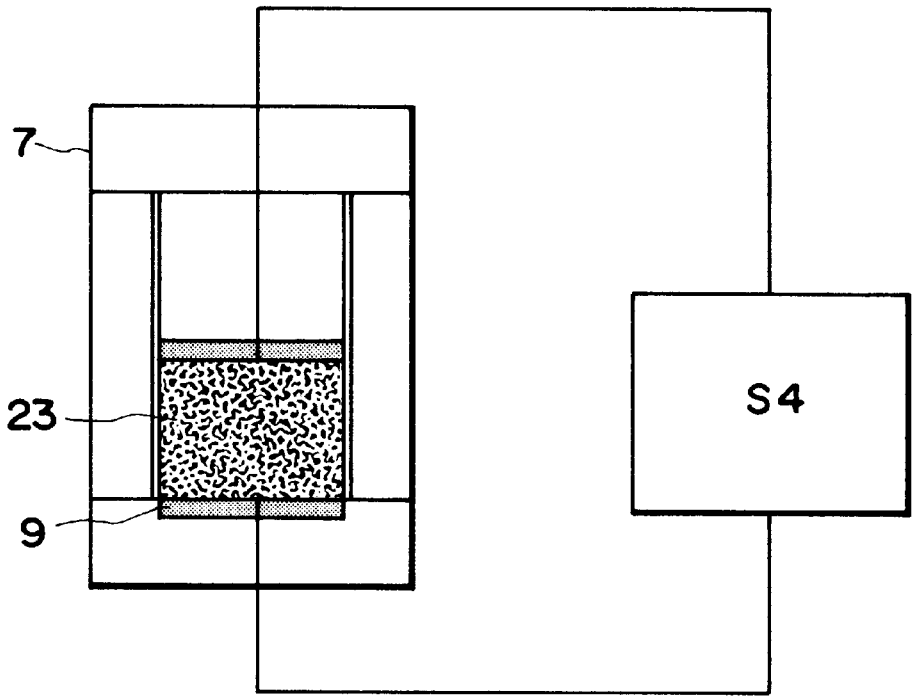
FIG. 4 shows a method of measuring a resistance of magnetic particles.

The resistance value of magnetic particles 23 is measured in the following manner. As shown in FIG. 4, 2 g of the magnetic particles 23 is placed in a metal cell 7 (bottom area 227 mm $^2$) to which voltage is applicable, and thereafter, they are pressed at 6.6 kg/cm$^2$, and the DC voltage is applied from voltage source S4. Designated by reference number 9 is electrode.

The magnetic brush 2 using magnetic particles 23 of copper zinc ferrite having the resistance property B in FIG. 3, was formed, and the image evaluation was made using the image forming apparatus. It has been confirmed that the leakage does not occur even if the photosensitive member 1 has a pin hole, and good images have been produced without charging defect.

The material of the magnetic particles 23 is not limited to copper zinc ferrite, but resin material carrier is usable if the resistance value is $1\times10^4$–$1\times10^7$ Ohm at application voltage 1–1000V. Then, good images can be provided. In the case of ferrite, the material is not limited to copper zinc ferrite. As described above, the third ionization potential of the bivalent metal ion is higher than the third ionization potential of iron ion, since then the resistance value is $1\times10^4$–$1\times10^7$ Ohm at application voltage 1–1000V. More particularly, nickel, manganese, magnesium or the like are usable other than copper and zinc. From the standpoint of stability in manufacturing and from the cost, copper zinc ferrite is desirable. The resistance value of $1\times10^4$–$1\times10^7$ Ohm upon application voltage 1–1000V may be provided by treating the surface of the magnetic particles 23 to reduce the resistance.

Embodiment 2

Figure 6:
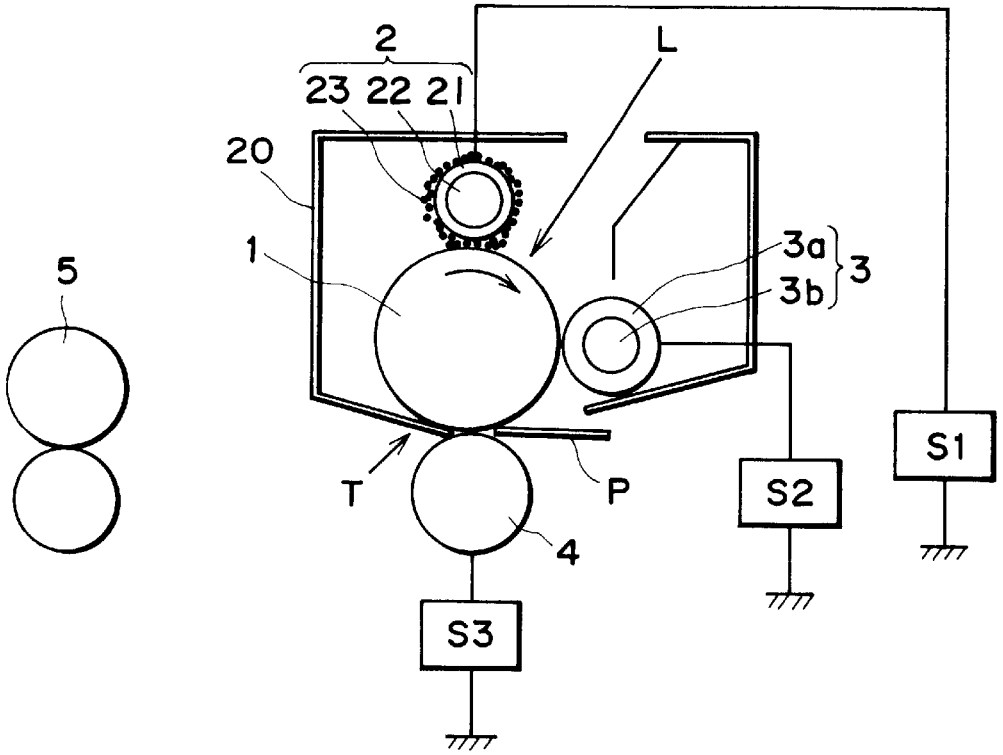
FIG. 6 is a schematic view of an image forming apparatus according to embodiment 2.

In this embodiment, the untransferred toner after image formation is temporarily collected by charging portion, and is removed by the developing zone, so that a cleaning device only for effecting the cleaning operation is not used. This embodiment is applicable to such an image forming apparatus. The image forming apparatus used in this embodiment is shown in FIG. 6. This is the same as embodiment 1, except that the charging member is supplied with an AC biased DC voltage, and that the cleaning device is not used.

The AC voltage is applied at the charging portion in order to collect the untransferred toner into the magnetic brush charger and to uniform the charge polarity of the toner to a regular polarity (the charge polarity is not uniform due to friction among toner same particles or friction with the photosensitive member). By doing so, the residual toner is discharged from the magnetic brush to facilitate the collection into the developing zone.

In this embodiment, the application voltage applied to the charging member was −700V, and the AC component had Vpp (peak-to-peak voltage) of 800V and frequency of 1 kHz, AC voltage with duty ratio of 50% in the form of rectangular wave.

The pin hole leakage in the case of the voltage in the form of an AC voltage biased with a DC voltage, is determined by the maximum application voltage to the charging member. In this embodiment, the resistance of magnetic particle upon −1100V application ((−700)+(−400)) is to be noted. On the other hand, the charging property is determined by the voltage difference between the DC voltage of the application voltage and the average potential of the photosensitive member surface immediately after one passage through the charging nip once. In this embodiment, the charging substantially to the DC potential is carried out, and therefore, the resistance value of the magnetic particle upon 1V application is to be noted. The magnetic particles used in this embodiment have the resistance of $3\times10^5$ Ohm upon 1100V application, and $8\times10^5$ Ohm upon 1V application, as in B in embodiment 1. Therefore, the current does not leak even if the photosensitive member has a pin hole, and the average of the potential of the photosensitive member surface immediately after one passage is $8\times10^5$ Ohm. Satisfactory charging property can be provided.

Thus, also when the AC voltage is superimposed on the DC voltage, the leakage at the pin hole does not occur and the charging property is satisfactory if the resistance value of the magnetic particle is $1\times10^4$–$1\times10^7$ Ohm between the application voltage 1V and maximum value. Accordingly, satisfactory images can be provided in the image forming apparatus without the cleaner device.

While the invention has been described with reference to the structures disclosed herein, it is not confined to the details set forth and this application is intended to cover such modifications or changes as may come within the purpose of the improvements or the scope of the following claims.

What is claimed is:

1. A charging device for charging a member to be charged, comprising:

a charging member to which a voltage is applicable to charge said member to be charged, said charging member having a brush of a mass of magnetic particles contactable to said member to be charged, and a supporting member for supporting said mass of magnetic particles;

wherein a resistance of said mass of magnetic particles is within a range of $1\times10^4$–$1\times10^7$ Ohms at any voltage applied thereto in the range of 1–1000(V), wherein the resistance of said mass of magnetic particles is determined for 2 g of said mass of magnetic particles placed in a metal cell having a bottom area of 227 mm$^2$ and pressed at a pressure of 6.6 kg/cm$^2$.

2. A device according to claim 1, wherein said mass of magnetic particles is a ferrite material, in which a third ionization potential of bivalent metal ion is higher than a third ionization potential of iron ion.

3. An image forming apparatus comprising:

an image bearing member;

a charging member to which a voltage is applicable to charge said image bearing member, said charging member having a brush of a mass of magnetic particles contactable to said image bearing member and a supporting member for supporting said mass of magnetic particles;

wherein a resistance of said mass of magnetic particles is within a range of $1\times10^4$–$1\times10^7$ Ohm at any voltage applied thereto in the range of 1–1000(V), wherein the resistance of said mass of magnetic particles is determined for 2 g of said mass of magnetic particles placed in a metal cell having a bottom area of 227 $mm^2$ and pressed at a pressure of 6.6 $kg/cm^2$.

4. An apparatus according to claim 3, wherein said image bearing member has a charge injection layer into which charge is injected by contact with said mass of magnetic particles.

5. An apparatus according to claim 4, wherein said charge injection layer has a volume resistivity of $1\times10^9$–$1\times10^{15}$ Ohm·cm.

6. An apparatus according to claim 3 or 4, wherein said mass of magnetic particles is a ferrite material, in which a third ionization potential of bivalent metal ion is higher than a third ionization potential of iron ion.

7. An apparatus according to claim 3 or 4, wherein a movement direction of said mass of magnetic particles is opposite from that of said image bearing member at a position where they are contacted to each other.

8. A charging device for charging a member to be charged, comprising:

a charging member to which a voltage is applicable to charge said member to be charged, said charging member having a brush of a mass of magnetic particles contactable to said member to be charged, and a supporting member for supporting said mass of magnetic particles;

wherein a resistance of said mass of magnetic particles is within a range of $1\times10^4$–$1\times10^7$ Ohm at any voltage applied thereto in the range of 1–Vmax(V), wherein the resistance of said mass of magnetic particles is determined for 2 g of said mass of magnetic particles placed in a metal cell having a bottom area of 227 $mm^2$ and pressed at a pressure of 6.6 $kg/cm^2$, and where Vmax (V) is a maximum value applied to said charging member.

9. A device according to claim 8, wherein said mass of magnetic particles is a ferrite material, in which a third ionization potential of bivalent metal ion is higher than a third ionization potential of iron ion.

10. An image forming apparatus comprising:

an image bearing member;

a charging member to which a voltage is applicable to charge said image bearing member, said charging member having a brush of a mass of magnetic particles contactable to said image bearing member, and a supporting member for supporting said mass of magnetic particles;

wherein a resistance of said mass of magnetic particles is within a range of $1\times10^4$–$1\times10^7$ Ohms at any voltage applied thereto in the range of 1–Vmax(V), wherein the resistance of the magnetic particles is determined for 2 g of the magnetic particles placed in a metal cell having a bottom area of 227 $mm^2$ and pressed at a pressure of 6.6 $kg/cm^2$, and where Vmax(V) is a maximum value applied to said charging member.

11. An apparatus according to claim 10, wherein said image bearing member has a charge injection layer into which charge is injected by contact with said mass of magnetic particles.

12. An apparatus according to claim 11, wherein said charge injection layer has a volume resistivity of $1\times10^9$–$1\times10^{15}$ Ohm·cm.

13. An apparatus according to claim 10 or 11 wherein said mass of magnetic particles is a ferrite material, in which an iron ion of bivalent third ionization potential is higher than a third ionization potential.

14. An apparatus according to claim 10 or 11, wherein a movement direction of said mass of magnetic particles is opposite from that of said image bearing member at a position where they are contacted to each other.

15. A device according to either claim 1 or 8, wherein said mass of magnetic particles injects electric charge into the member to be charged by contact to the member to be charged.

* * * * *

UNITED STATES PATENT AND TRADEMARK OFFICE

CERTIFICATE OF CORRECTION

PATENT NO. : 6,157,800
DATED : December 5, 2000
INVENTOR(S) : Harumi Ishiyama et al.

It is certified that error appears in the above-identified patent and that said Letters Patent is hereby corrected as shown below:

Title page,
Item [56], "Sense of D2=E.U. Condon" should read -- U. Condon --; and after "pp. 4-8" insert -- 4-9, and --.

Column 1,
Line 31, "particle" should read -- particles --.

Column 2,
Line 22, "an an" should read -- an --;
Line 44, "beam 6" should read -- beam L --; and
Line 53, "sleeve 3" should read -- sleeve 3a --.

Column 3,
Line 64, "particle" should read -- particles --.

Column 4,
Line 36, "1, 1 (peripheral" should read -- 1 (peripheral --;
Line 42, "is" should read -- are --; and
Line 62, "than" should read -- as compared with --.

Column 5,
Line 23, "examples" should read -- examples of --;
Line 30, "provided" should read -- is provided --;
Line 44, sense of "charging nip-like appear"; and
Line 46, "voltage" should read -- voltages --.

Column 7,
Lines 5 and 10, "electronic" should read -- electrons --;
Line 60, "to uniform" should read -- to make uniform --; and
Line 62, "same" should be deleted.

UNITED STATES PATENT AND TRADEMARK OFFICE

CERTIFICATE OF CORRECTION

PATENT NO. : 6,157,800
DATED : December 5, 2000
INVENTOR(S) : Harumi Ishiyama et al.

It is certified that error appears in the above-identified patent and that said Letters Patent is hereby corrected as shown below:

Column 8,
Line 15, "particle" should read -- particles --.

Column 10,
Lines 27 and 28, sense of "iron ion of bivalent third ionization potential is higher than a third ionization potential".

Signed and Sealed this

Twenty-fifth Day of December, 2001

*Attest:*

*Attesting Officer*

JAMES E. ROGAN
*Director of the United States Patent and Trademark Office*